United States Patent [19]

Kobayashi et al.

[11] 4,333,432

[45] Jun. 8, 1982

[54] FUEL INJECTION PUMP

[75] Inventors: Masayoshi Kobayashi; Toru Sakuranaka; Sachio Nakagawa, all of Higashi Matsuyama, Japan

[73] Assignee: Diesel Kiki Company, Ltd., Tokyo, Japan

[21] Appl. No.: 126,246

[22] Filed: Mar. 3, 1980

[30] Foreign Application Priority Data

Mar. 10, 1979 [JP] Japan ..... 54-29886[U]

[51] Int. Cl.[3] ..... F02D 1/04; F02D 1/06

[52] U.S. Cl. ..... 123/366; 123/368; 123/373; 123/449

[58] Field of Search ..... 123/366, 373, 374, 368, 123/449

[56] References Cited

U.S. PATENT DOCUMENTS

| | | | |
|---|---|---|---|
| 3,970,064 | 7/1976 | Eheim | 123/373 |
| 3,974,812 | 8/1976 | Konrath | 123/373 |
| 3,974,814 | 8/1976 | Eheim | 123/373 |
| 4,038,958 | 8/1977 | Susuki | 123/373 |
| 4,148,290 | 4/1979 | Knorreck | 123/373 |
| 4,220,128 | 9/1980 | Kobayashi | 123/366 |

*Primary Examiner*—Ronald B. Cox

*Attorney, Agent, or Firm*—David G. Alexander

[57] ABSTRACT

A start lever (56) and a tension lever (18) are rotatable about a pin (19). The tension lever (18) is connected to a fuel control sleeve (28) so that an amount of fuel pumped and injected into an engine depends on the position of the tension lever (18) and sleeve (28). Upon rotation of flyweights (13), a governor rod (52) is urged through a hole (54) in the start lever (52) toward the tension lever (18) against the force of a start spring (22). A flange (53) formed on the governor rod (52) abuts against the start lever (18) so that the force of the start spring (22) is transmitted to the flyweights (13). The end of governor rod (52) abuts against the tension lever (18) at a certain engine speed so that further movement of the governor rod (52) is opposed by a governor spring (26) connected to the tension lever (18).

3 Claims, 3 Drawing Figures

FUEL INJECTION PUMP

BACKGROUND OF THE INVENTION

The present invention relates to a fuel injection pump which may be, but is not limited to, the distribution type.

In a distribution type fuel injection pump such as disclosed in U.S. Pat. No. 3,906,916, a fuel control sleeve is positioned by flyweights to control the amount of fuel injection in accordance with engine speed. Flyweights urge a governor rod toward a tension lever as the engine speed increases. At a certain engine speed, the governor rod engages the tension lever and moves the same against the force of a governor spring to move the sleeve in a direction to decrease the amount of fuel injection.

A start lever is rotatably mounted on a same pin as the tension lever and is urged by a start spring to abut against the end of the governor rod. Thus, the flyweights must first oppose the force of the start spring. At a certain engine speed, the start lever is moved by the governor rod to abut against the tension lever, after which point the flyweights must oppose the combined forces of the start spring and governor spring.

A problem has existed in this type of pump in that the start lever tends rotate or twist about an axis perpendicular to the pin instead of being moved straight by the governor rod. This has a substantial adverse effect on the accuracy of fuel injection control. After a long period of use, the governor rod forms a concave depression in the start lever which yet further contributes to inaccurate fuel injection control.

SUMMARY OF THE INVENTION

A fuel injection pump embodying the present invention includes a pin, a start lever rotatable about the pin, a tension lever rotatable about the pin, a start spring urging the start lever away from the tension lever, engine driven flyweights urging the start lever toward the tension lever when rotated, a governor spring urging the tension lever toward the start lever and a fuel control member operatively connected to the tension lever, and is characterized by comprising a governor rod connected to the flyweights and being moved toward the tension lever upon rotation of the flyweights, the start lever being formed with a hole through which the governor rod extends, the governor rod being formed with a flange having a diameter larger than the hole for abutment with the start lever before an end of the governor rod abuts against the tension lever.

In accordance with the present invention, a start lever and a tension lever are rotatable about a pin. The tension lever is connected to a fuel control sleeve so that an amount of fuel pumped and injected into an engine depends on the position of the tension lever and sleeve. Upon rotation of flyweights, a governor rod is urged through a hole in the start lever toward the tension lever against the force of a start spring. A flange formed on the governor rod abuts against the start lever so that the force of the start spring is transmitted to the flyweights. The end of governor rod abuts against the tension lever at a certain engine speed so that further movement of the governor rod is opposed by a governor spring connected to the tension lever.

It is an object of the present invention to provide a fuel injection pump governor which overcomes the drawbacks of the prior art and enables more accurate control of fuel injection.

It is another object of the present invention to provide a fuel injection pump which is more durable and requires less maintenance than prior art fuel injection pumps of comparable type.

It is another object of the present invention to provide a generally improved fuel injection pump.

Other objects, together with the foregoing, are attained in the embodiment described in the following description and illustrated in the accompanying drawing.

DESCRIPTION OF THE PREFERRED EMBODIMENTS

While the fuel injection pump of the invention is susceptible of numerous physical embodiments, depending upon the environment and requirements of use, substantial numbers of the herein shown and described embodiment have been made, tested and used, and all have performed in an eminently satisfactory manner.

Figure 1:
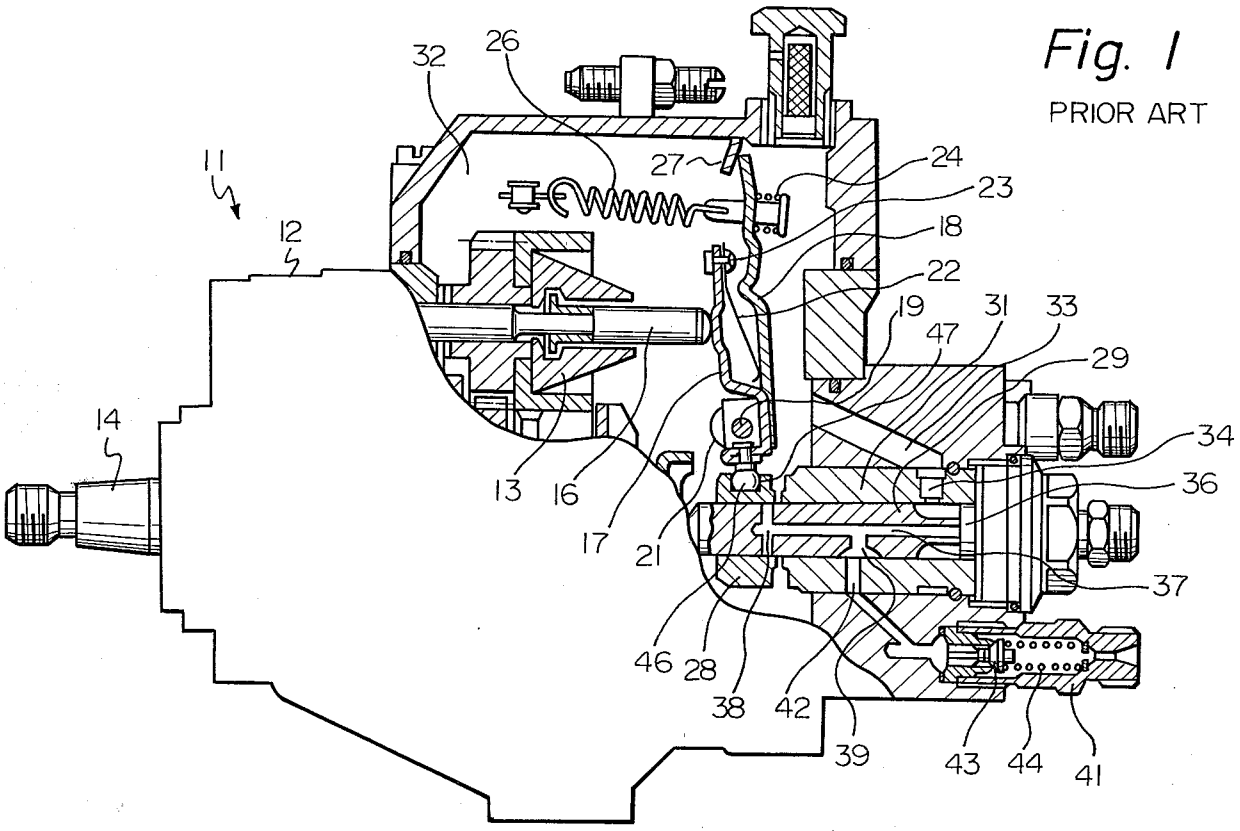
Fig. 1 PRIOR ART
FIG. 1 is a partially cutaway longitudinal elevation of a prior art fuel injection pump.

Referring now to FIG. 1 of the drawing, a prior art distribution type fuel injection pump is generally designated by the reference numeral 11 and comprises a housing 12. Flyweights 13 are rotatably driven by an input shaft 14 which is in turn driven by an internal combustion engine (not shown). Rotation of the flyweights 13 causes a governor rod or shaft 16 to be moved rightwardly to an extent which depends on the engine speed.

A start lever 17 and a tension lever 18 are rotatably mounted on a pin 19. The pin 19 is fixed in an eccentric manner to a shaft 21 which is, although not illustrated, manually rotated to displace the pin 19 and thereby control an amount of fuel injection and the engine speed within an operational speed range.

A start spring 22 is disposed between the start lever 17 and the tension lever 18 and urges the start lever 17 leftwardly into engagement with the end of the governor rod 16. When the engine speed reaches a predetermined value, the governor rod 16 will be moved by the flyweights 13 against the force of the spring 22 so that a button 23 fixed to the start lever 17 abuts against the tension lever 18.

The tension lever 18 is urged by an idling spring 24 and a governor spring 26 leftwardly toward engagement with a stop 27. As the engine speed increases, the flyweights 13 and governor rod 16 overcome the forces of the idling spring 24 and governor spring 26 in this order and displace the start lever 17 and tension lever 18 in a unitary manner rightwardly, or clockwise about the pin 19. The preload of the spring 24 sets the engine idling speed whereas the preload of the spring 26 sets the maximum engine speed.

A control sleeve 28 is slidable on a plunger or piston 49 which is in turn slidably supported within a cylinder 31 fixed to the housing 12. Fuel is supplied into a chamber 32 defined inside the housing 12 by a supply pump (not shown) and led into a compression chamber 36 through a passageway 33 and port 34. The compression chamber 36 communicates with an axial bore 37 formed in the plunger 29 and a radial passageway 38 leading from the bore 37.

A distribution port 39 also leads from the bore 37 and opens in the radial direction. Although only one nozzle is visible in the drawing, a plurality of fuel injection nozzles are able to communicate with the port 39 in a manner which will be described above. The fuel injection nozzle which is visible in the drawing is designated as 41 and opens into a cylinder (not illustrated) of the engine. The nozzle 41 communicates with the cylinder 31 through a passageway 42. A check valve 43 biased by a spring 44 opens when the pressure in the passageway 42 is above a predetermined value to alow fuel injection.

In practice, a plurality of fuel injection nozzles are provided and communicate with the cylinder 31 by passageways identical to the passageway 42 which are circumferentially spaced about the cylinder 31. The plunger 29 is simultaneously reciprocated and rotated by the shaft 14 so that the port 39 aligns with the passageways 42 in a sequential manner to distribute fuel to the plurality of fuel injectors.

As illustrated, when the plunger 29 is moved rightwardly, fuel is compressed to a high pressure in the chamber 36 since the passageway 38 is blocked by the sleeve 28. The fuel is forced from the chamber 36 through the bore 37, port 39 and passageway 42 to the fuel injection nozzle 41 from which the fuel is injected into the engine when the pressure in the passageway 42 is sufficient to overcome the preload of the spring 44.

At a certain position, the passageway 38 will move rightwardly of the right end of the sleeve 28 and communicate with the low pressure chamber 32. At this point, the pressure in the bore 37 and compression chamber 36 will drop to a very low value (below the preload of the spring 44) since these spaces now communicate with the chamber 32. At this point, fuel injection will be terminated.

The amount of fuel injection depends on the position of the sleeve 28. The more leftward the sleeve 28, the earlier the point in the compression stroke of the plunger 29 at which the passageway 38 is unblocked and the earlier fuel injection will terminate. The earlier the fuel injection termination point, the smaller the amount of fuel which will be injected into the engine and the lower the engine speed.

The lower end of the tension lever 18 carries a ball 46 which fits in a socket 47 formed in the control sleeve 29. Clockwise rotation of the tension lever 18 causes the sleeve 28 to move leftwardly and reduce the amount of fuel injection. It will be noted that the tension lever 18 is rotated clockwise by the flyweights 13 as the engine speed increases, and therefore the amount of fuel injection is reduced as the engine speed increases.

The prior art fuel injection pump 11 suffers from the fact that the start lever 17 tends to rotate or twist about an axis perpendicular to the pin 19. More specifically, the start lever 17 twists about an axis which is vertical in FIG. 1. In other cases, the pin 19 is not exactly perpendicular to the plane of the drawing, causing the same problem. In addition, the right end of the governor rod 16 tends to form a concave depression in the left surface of the start lever 17. All of these factors contribute to a reduction of the accuracy of fuel injection control below an acceptable level.

Figure 2:
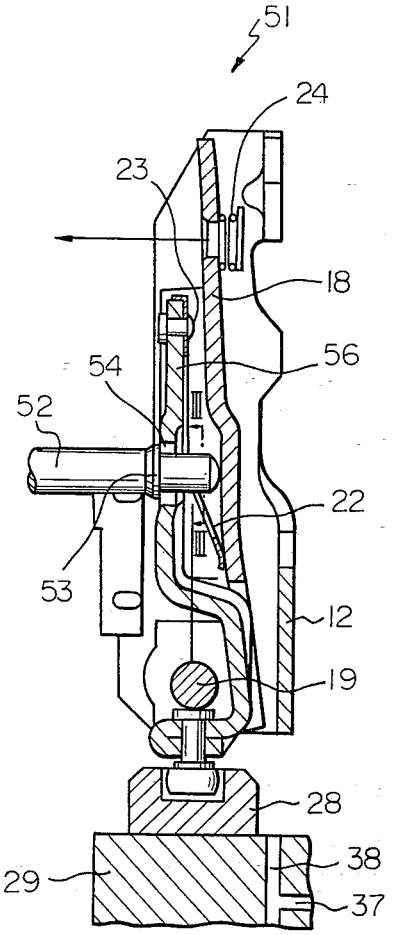
FIG. 2 is an enlarged fragmentary elevation illustrating the improvement of the present invention.
Figure 3:
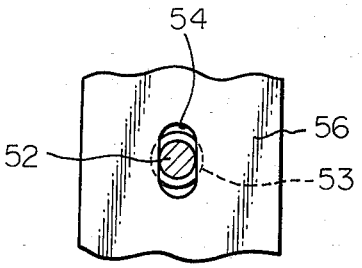
FIG. 3 is a section taken on a line III—III of FIG. 2.

These drawbacks are overcome in a fuel injection pump 51 which is illustrated in fragmentary form in FIGS. 2 and 3. Like elements are designated by the same reference numerals used in FIG. 1.

A governor rod 52 generally corresponds to the governor rod 16 but is formed with a flange 53. The right end portion of the governor rod 52 extends through a hole 54 in a modified start lever 56. The flange 53 is larger in diameter than the hole 54 so that the flange 53 may abut against the start lever 56.

In operation, the start lever 56 is urged leftwardly by the spring 22 so that the left surface of the start lever 56 abuts against the flange 53. Rightward movement of the governor rod 52 causes the start lever 56 to move toward the tension lever 18 against the force of the spring 22. At a certain engine speed, the right end of the governor rod 52 will abut against the tension lever 18 and move the same rightwardly (clockwise) to reduce the amount of fuel injection.

The improvement comprising the flange 53 and hole 54 is advantageous in that the tension lever 18 is moved directly by the governor rod 52 rather than through the intermediary of the start lever 17 as in the prior art. The flange 53 has a larger area and diameter than the end of the governor rod 52 and thereby urges the start lever 56 to a straight position even if the start lever 56 was initially rotated or twisted about a vertical axis in the drawing. In this manner, the drawbacks of the prior art are overcome and the start lever 56 is maintained straight to effect accurate fuel injection control.

In summary, it will be seen that the present invention overcomes the drawbacks of the prior art and substantially increases the accuracy of fuel injection and also reduces the maintenance requirements of the fuel injection pump. Various modifications will become possible for those skilled in the art after receiving the teachings of the present disclosure without departing from the scope thereof.

What is claimed is:

1. A fuel injection pump including a pin, a start lever rotatable about the pin, a tension lever rotatable about the pin, a start spring urging the start lever away from the tension lever, engine driven flyweights urging the start lever toward the tension lever when rotated, a governor spring urging the tension lever toward the start lever and a fuel control member operatively connected to the tension lever, characterized by comprising:

a governor rod connected to the flyweights and being moved toward the tension lever upon rotation of the flyweights, the start lever being formed with a hole through which the governor rod extends, the governor rod being formed with a flange having a diameter larger than the hole for abutment with the start lever before an end of the governor rod abuts against the tension lever.

2. A pump as in claim 1, further comprising a stop, the governor spring urging the tension lever toward the stop.

3. A pump as in claim 1, in which the fuel control member comprises a control sleeve, the pump further comprising a plunger which is slidably rotated and reciprocated in the control sleeve for pumping and distribution of fuel, the tension lever axially moving the control sleeve relative to the plunger.

* * * * *